US009279308B2

(12) United States Patent
June

(10) Patent No.: US 9,279,308 B2
(45) Date of Patent: Mar. 8, 2016

(54) VERTICAL COMPLETION SYSTEM INCLUDING TUBING HANGER WITH VALVE

(71) Applicant: OneSubsea IP UK Limited, London (GB)

(72) Inventor: David R. June, Houston, TX (US)

(73) Assignee: OneSubsea LLC, Houston, TX (US)

( * ) Notice: Subject to any disclaimer, the term of this patent is extended or adjusted under 35 U.S.C. 154(b) by 0 days.

(21) Appl. No.: 13/971,268

(22) Filed: Aug. 20, 2013

(65) Prior Publication Data

US 2015/0053412 A1 Feb. 26, 2015

(51) Int. Cl.

| | |
|---|---|
| ***E21B 43/01*** | (2006.01) |
| ***E21B 34/04*** | (2006.01) |
| ***E21B 33/043*** | (2006.01) |

(52) U.S. Cl.

CPC ..... *E21B 34/04* (2013.01); *E21B 33/043* (2013.01)

(58) Field of Classification Search

None

See application file for complete search history.

(56) References Cited

U.S. PATENT DOCUMENTS

| | | | | |
|---|---|---|---|---|
| 4,116,044 | A | 9/1978 | Garrett | |
| 4,449,583 | A | 5/1984 | Lawson | |
| 4,903,774 | A | 2/1990 | Dykes et al. | |
| 5,143,158 | A | 9/1992 | Watkins et al. | |
| 5,366,017 | A | 11/1994 | Voss, Jr. | |
| 5,503,230 | A | 4/1996 | Osborne et al. | |
| 5,544,707 | A | 8/1996 | Hopper et al. | |
| 6,039,119 | A | 3/2000 | Hopper et al. | |
| 6,082,460 | A | 7/2000 | June | |
| 6,186,239 | B1 | 2/2001 | Monjure et al. | |
| 6,360,822 | B1 | 3/2002 | Robertson | |
| 6,378,613 | B1 | 4/2002 | Kent et al. | |
| 6,408,947 | B1 | 6/2002 | Cunningham et al. | |
| 6,513,596 | B2 | 2/2003 | Wester | |
| 6,547,008 | B1 | 4/2003 | Hopper et al. | |
| 6,655,455 | B2 | 12/2003 | Bartlett et al. | |
| 6,705,401 | B2 | 3/2004 | Buckle et al. | |
| 6,729,392 | B2 | 5/2004 | DeBerry et al. | |
| 6,763,891 | B2 | 7/2004 | Humphrey et al. | |
| 6,991,039 | B2 | 1/2006 | Hopper et al. | |
| 7,044,227 | B2 | 5/2006 | Jennings et al. | |
| 7,073,591 | B2 | 7/2006 | Massie et al. | |
| 7,093,660 | B2 | 8/2006 | Hopper et al. | |
| 7,096,937 | B2 * | 8/2006 | Bartlett et al. | 166/86.2 |
| 7,117,945 | B2 | 10/2006 | Hopper et al. | |

(Continued)

FOREIGN PATENT DOCUMENTS

WO 2004022908 A1 3/2004

OTHER PUBLICATIONS

International Search Report and Written Opinion dated May 17, 2010 for PCT Application No: PCT US2009/062373 filed Oct. 28, 2009.

(Continued)

*Primary Examiner* — Matthew R Buck
*Assistant Examiner* — Douglas S Wood
(74) *Attorney, Agent, or Firm* — Chamberlain Hrdlicka

(57) ABSTRACT

A subsea completion system for a subsea well includes a tubing spool including an internal bore formed therethrough and a tubing hanger movable into a landed position within the internal bore of the tubing spool. The tubing hanger includes a production bore formed therethrough, an auxiliary passage formed therethrough outside of the production bore, and a valve in fluid communication with the auxiliary passage to control the flow of fluid through the auxiliary passage.

20 Claims, 4 Drawing Sheets

(56) References Cited

U.S. PATENT DOCUMENTS

| | | | | |
|---|---|---|---|---|
| 7,191,830 | B2 | 3/2007 | McVay et al. | |
| 7,308,943 | B2 | 12/2007 | Hopper et al. | |
| 7,314,085 | B2 | 1/2008 | Hopper et al. | |
| 7,314,086 | B2 | 1/2008 | Hopper | |
| 7,419,001 | B2 | 9/2008 | Broussard | |
| 7,500,524 | B2 | 3/2009 | Hopper et al. | |
| 7,604,047 | B2 | 10/2009 | Broussard | |
| 8,157,015 | B2 | 4/2012 | Voss et al. | |
| 8,316,946 | B2 * | 11/2012 | June | E21B 33/043 166/319 |
| 2002/0117305 | A1 | 8/2002 | Calder et al. | |
| 2003/0121667 | A1 | 7/2003 | Massie et al. | |
| 2010/0101800 | A1 | 4/2010 | June et al. | |
| 2012/0048567 | A1 | 3/2012 | June | |

OTHER PUBLICATIONS

International Search Report and Written Opinion dated Dec. 16, 2014, issued in corresponding application PCT/US2014/051720, filed Aug. 19, 2014, 15 pgs.

* cited by examiner

VERTICAL COMPLETION SYSTEM INCLUDING TUBING HANGER WITH VALVE

BACKGROUND

To meet the demand for natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a completion system that includes wellhead assembly through which the resource is extracted. These completion systems may include a wide variety of components, such as various casings, hangers, valves, fluid conduits, and the like, that control drilling and/or extraction operations.

One type of completion assembly includes a wellhead with one or more strings of casing supported by casing hangers in the wellhead. Attached to the wellhead may be a tubing spool with a tubing hanger secured to a string of tubing that lands in the tubing spool above the wellhead. The tubing spool may have a plurality of vertical passages that surround a vertical bore. The vertical fluid passages provide access through the tubing spool for hydraulic fluid or electrical lines to operate and control equipment located downhole, such a safety valves or chemical injection units. Electrical and/or hydraulic control lines may extend alongside the outside of the tubing to control downhole valves, temperature sensors, and the like. A production tree is then installed on top of the tubing spool. The production tree has a vertical bore that receives upward flow of fluid from the tubing string and wellhead.

Further, over the last thirty years, the search for oil and gas offshore has moved into progressively deeper waters. Wells are now commonly drilled at depths of several hundreds, to even several thousands, of feet below the surface of the ocean. In addition, wells are now being drilled in more remote offshore locations. As such, it remains a priority to reduce the complexity and height of completion systems, thereby assisting to prevent failure and reduce the footprint of the completion systems, particularly in these remote locations where maintenance may be difficult.

BRIEF DESCRIPTION OF THE DRAWINGS

For a detailed description of the preferred embodiments of the invention, reference will now be made to the accompanying drawings in which.

DETAILED DESCRIPTION

Figure 1A:
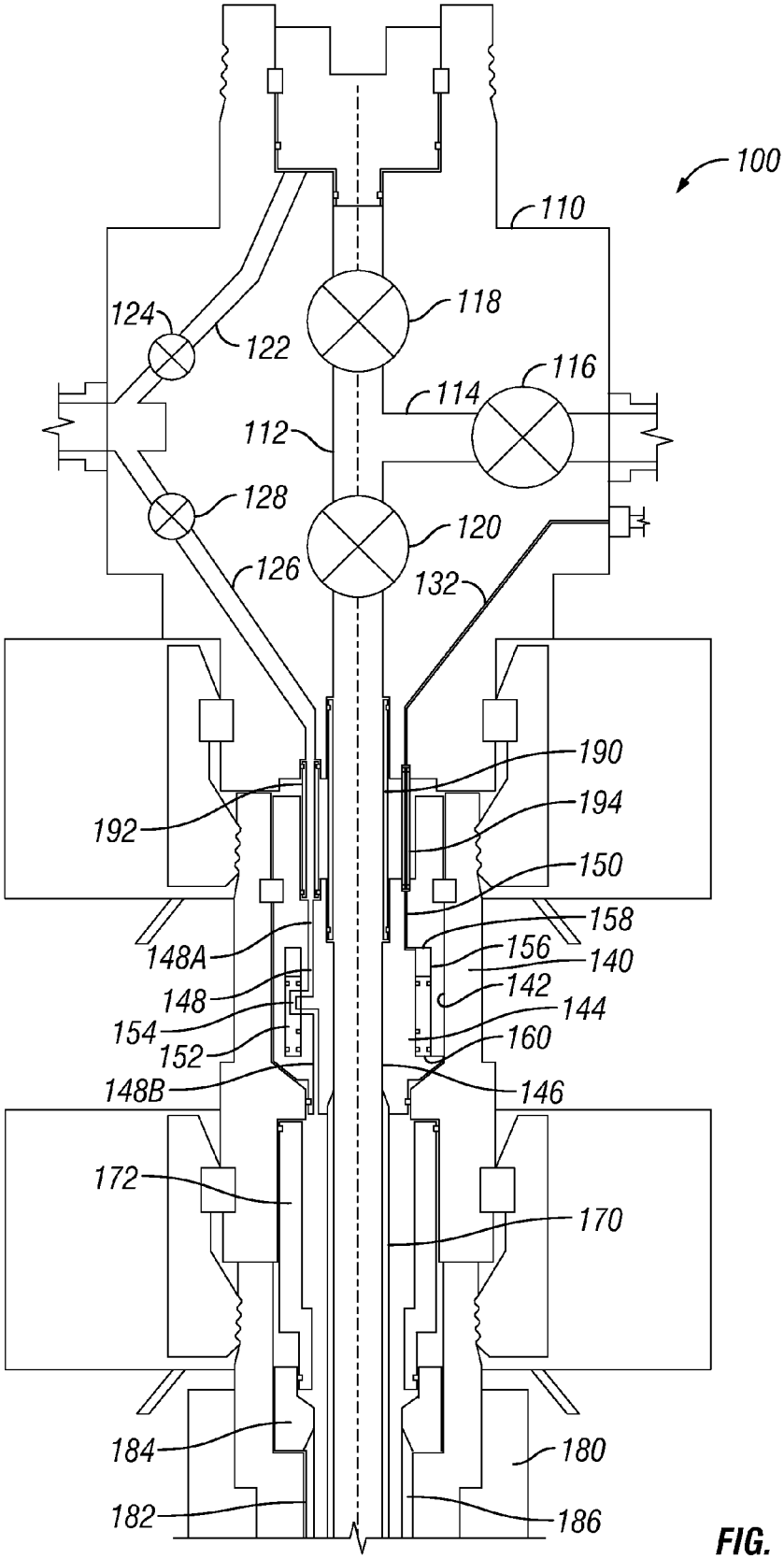
FIGS. 1A and 1B show multiple cross-sectional views of a completion system for a well in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Accordingly, disclosed herein is a subsea completion and/or production system for a subsea well that may include and/or be used with a production tree. The production tree may be subsea, and may include conventional (e.g., vertical), horizontal, dual bore, and mono bore trees. The production tree may be installable on other components of the subsea completion system, such as installable on a tubing spool. The subsea completion system may include the tubing spool with an internal bore formed therethrough, with a tubing hanger movable into a landed position within the internal bore. The tubing hanger may include a production bore formed therethrough, one or more auxiliary passages formed therethrough outside of the production bore, and a valve in fluid communication with the auxiliary passage to control the flow of fluid through the auxiliary passage. As such, in accordance with one or more embodiments of the present disclosure, the tubing spool may be valve-less, such that only the tubing hanger includes a valve to control fluid flow through the tubing spool and the tubing hanger. Further, the valve in the tubing hanger may be a sliding sleeve valve.

Figure 1B:
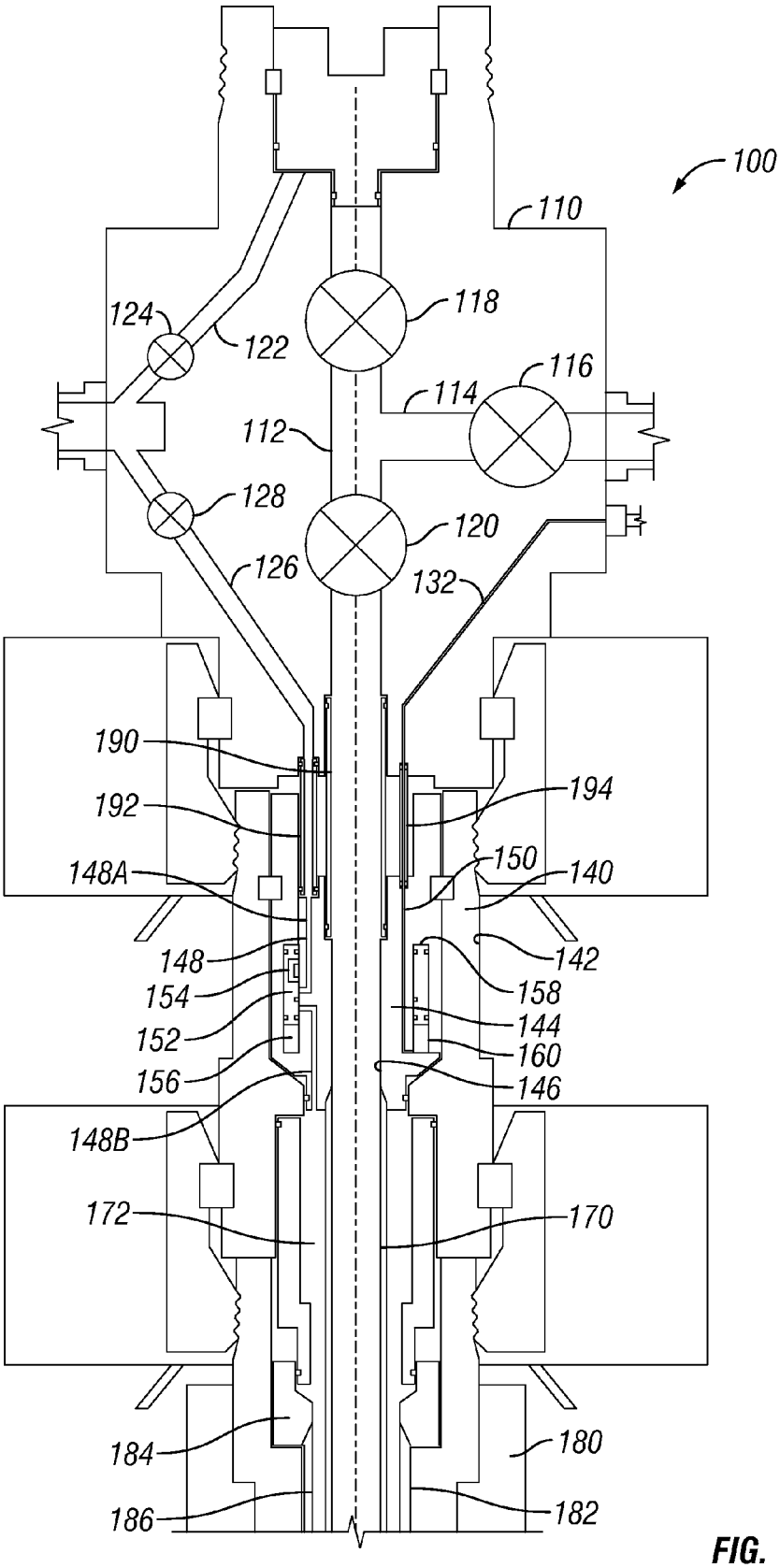

Referring now to FIGS. 1A and 1B, multiple cross-sectional views of a completion system 100 for a well in accordance with one or more embodiments of the present disclosure are shown. As discussed above, the completion system 100 may be subsea, such as when used with a subsea well. The completion system 100 may include a production tree 110, such as a vertical subsea production tree as shown. The production tree 110 may include a main production bore 112 formed therethrough with a wing bore 114 intersecting with and extending from the main production bore 112. The wing bore 114 may include one or more valves in fluid communication therewith, such as a wing valve 116 that may be used to control the flow of fluid through the wing bore 114.

Further, the production tree 110 may include one or more valves in fluid communication therewith, such as a production swab valve 118 and/or a production master valve 120 in fluid communication with the main production bore 112 to control the flow of fluid through the main production bore 112. For example, the production swab valve 118 may be included within the main production bore 112 above the intersection of the main production bore 112 and the wing bore 114, and the production master valve 120 may be included within the main production bore 112 below the intersection of the main production bore 112 and the wing bore 114.

The production tree 110 may include one or more auxiliary passages, such as an annulus flow path, that is formed within the production tree 110 and outside of the main production bore 112 (e.g., out of fluid communication with the main production bore 112). For example, as shown, the production tree 110 may include an upper auxiliary passage 122 with an upper valve 124 in fluid communication with the main production bore 112 above the intersection with the wing bore 114 and/or may include a lower auxiliary passage 126 with a lower valve 128 in fluid communication with the main production bore 112 below the intersection with the wing bore 114. As shown, the upper auxiliary passage 122 may be in fluid communication with the lower auxiliary passage 126.

Further, in addition to the auxiliary passage, the production tree 110 may include one or more valve control passages, such as a valve control passage 132 formed therethrough and outside of the main production bore 112 and the auxiliary passage within the production tree 110. For example, the valve control passage 132 may be used to control one or more valves within the completion system 100.

The production tree 110 may be connected to a tubing spool 140, such as installed or mounted on a top side of the tubing spool 140. Further, the tubing spool 140 may be connected to a wellhead 180, such as installed or mounted on a top side of the wellhead 180. The tubing spool 140 may include an internal bore 142 formed therethrough, such as extending from a top side of the tubing spool 140 down and through to a bottom side of the tubing spool 140.

Further, as shown, a tubing hanger 144 may be moved into a landed position within the tubing spool 140, such as by having the tubing hanger 144 landed into the internal bore 142 of the tubing spool 140 below the production tree 110. The tubing hanger 144 may include a production bore 146 formed therethrough, one or more auxiliary passages 148 formed therethrough, and/or one or more valve control passages 150 formed therein. For example, the tubing hanger 144 may include the auxiliary passage 148 formed therethrough, such as extending from a top side of the tubing hanger 144 to a bottom side of the tubing hanger 144, which is outside of the production bore 146 (e.g., out of fluid communication with the production bore 146). The tubing hanger 144 may also include the valve control passage 150 formed therein that is outside of the production bore 146 and the auxiliary passage 148.

Referring still to FIGS. 1A and 1B, the tubing hanger 144 may include one or more valves, such as a valve 152, included therein to control the flow of fluid therethrough. For example, the valve 152 may be in fluid communication with the auxiliary passage 148, thereby enabling the valve 152 to control the flow of fluid through the auxiliary passage 148. As shown, the tubing hanger 144 may include a cavity 156 formed therein, such as an annular cavity formed about the production bore 146. The valve 152 may be positioned within the cavity 156, such as by having the valve 152 movable between an open position and a closed position within the cavity 156. For example, as shown in FIG. 1A, the valve 152 may be in the open position, thereby allowing fluid to flow through the auxiliary passage 148, and as shown in FIG. 1B, the valve 152 may be in the closed position, thereby preventing fluid to flow through the auxiliary passage 148.

As the valve 152 may be positioned and movable within the cavity 156, the auxiliary passage 148 may include one or more portions that are in fluid communication with the valve 152 and the cavity 156. For example, in accordance with one or more embodiments, as shown, the auxiliary passage 148 may include an upper portion 148A and a lower portion 148B. As shown, the upper portion 148A of the auxiliary passage 148 may extend from the top side of the tubing hanger 144 to the cavity 156, and the lower portion 148B of the auxiliary passage 148 may extend from the cavity 156 to the bottom side of the tubing hanger 144.

Further, as the valve 152 may be positioned and movable within the cavity 156, the one or more valve control passages 150 formed within the tubing hanger 144 may be in fluid communication with the valve 152 and the cavity 156 to control the valve 152. For example, the valve control passage 150 may extend from the top side of the tubing hanger 144 to the cavity 156 to control the movement of the valve 152 between the open position and the closed position. In particular, in accordance with one or more embodiments, increased pressure, such as fluid pressure, may be supplied through the valve control passage 150 to an opening side 158 of the cavity 156 to move the valve 152 into the open position, such as shown in FIG. 1A. In the open position, a flow passage 154 of the valve 152 may be aligned with the auxiliary passage 148, such as aligned between the upper portion 148A and the lower portion 148B of the auxiliary passage 148, thereby allowing fluid to flow through the auxiliary passage 148. Additionally, increased pressure may be supplied through the valve control passage 150 to a closing side 160 of the cavity 156 to move the valve 152 into the closed position, such as shown in FIG. 1B. In the closed position, the flow passage 154 of the valve 152 may be out-of-alignment with the auxiliary passage 148, such as out-of-alignment between the upper portion 148A and the lower portion 148B of the auxiliary passage 148, thereby preventing fluid to flow through the auxiliary passage 148. Accordingly, as shown, the valve 152 may be a sliding sleeve valve, though any other valve known in the art, such as a gate valve or a ball valve, may be used in accordance with one or more embodiments of the present disclosure.

One having ordinary skill in the art will appreciate that, though it is described that increased pressure may be provided to the opening side or the closing side of the cavity to move the valve between the open position and the closed position within the cavity, those having ordinary skill in the art will appreciate that other mechanisms and/or other configurations may be used without departing from the scope of the present disclosure to move the valve between the open position and the closed position. For example, in one embodiment, decreased pressure, such as a vacuum, may be used to move the valve between the open position and the closed position. In such an embodiment, increased pressure may be supplied through the valve control passage 150 to the opening side 158 of the cavity 156 to move the valve 152 into the open position, and decreased pressure may be supplied through the valve control passage 150 to the opening side 158 of the cavity 156 to move the valve 152 into the closed position. In addition or in alternative to the use of pressure, one or more actuators may be used to move the valve between the open position and the closed position. Accordingly, the present disclosure contemplates other configurations and embodiments than those only shown in the accompanying figures.

Referring still to FIGS. 1A and 1B, the tubing hanger 144 may be used to support production tubing 170 therefrom. For example, an upper end of the production tubing 170 may be supported within the production bore 146 of the tubing hanger 144, thereby forming an annulus 172 outside of the production tubing 170. The wellhead 180 may include a central bore 182, in which the production tubing 170 supported from the tubing hanger 144 may extend, at least partially, into the central bore 182 of the wellhead 180.

Further, in one or more embodiments, a casing hanger may be included within the completion system 100, such as by having a casing hanger 184 moved into a landed position within the central bore 182 of the wellhead 180 below the tubing spool 140. As such, production casing 186 may be supported from the casing hanger 184 and extend into the central bore 182 of the wellhead 180. As shown, in such an embodiment, the production casing 186 may surround the production tubing 170, thereby having the annulus 172 defined as the annular area between the production tubing 170 and the production casing 186. As such, in one or more embodiments, the annulus 172 may be formed between the exterior of the production tubing 170 and the interior of the production casing 186 and/or the central bore 182 of the wellhead 180. Accordingly, the auxiliary passage 148 of the tubing hanger 144 may be in fluid communication with the annulus 172, thereby enabling fluid to selectively flow into and/or out-of the annulus 172 through the auxiliary passage 148 of the tubing hanger 144.

When the production tree 110 is installed on the tubing spool 140, as shown in FIGS. 1A and 1B, the main production bore 112 of the production tree 110 may be in fluid communication with the production bore 146 of the tubing hanger 144. Further, in such an embodiment, the auxiliary passage of the production tree 110, such as the upper auxiliary passage 122 and/or the lower auxiliary passage 126, may be in fluid communication with the auxiliary passage 148 of the tubing hanger 144, and the valve control passages of the production tree 110, such as the valve control passage 132, may be in fluid communication with valve control passages of the tubing hanger 144, such as the valve control passage 150.

Accordingly, to have the bores and passages in the production tree and in the tubing spool within the completion system to be in fluid communication with each other, one or more isolation sleeves, stabs, conduits, tubulars, pipes, channels, mandrels, and/or any other similar component may or may not be used to fluidly couple the bores and passages within the production tree and the tubing spool to each other. For example, as shown in FIGS. 1A and 1B, a production bore stab 190 may be positioned between the main production bore 112 of the production tree 110 and the production bore 146 of the tubing hanger 144. Such an arrangement may enable the production bore stab 190 to isolate and fluidly couple the main production bore 112 of the production tree 110 to the production bore 146 of the tubing hanger 144. As such, one end of the production bore stab 190, such as the top end shown in FIGS. 1A and 1B, may seal against and within the main production bore 112 of the production tree 110, and another end of the production bore stab 190, such as the bottom end shown in FIGS. 1A and 1B, may seal against and within the production bore 146 of the tubing hanger 144. This arrangement may enable the production bore of the production tree 110 and the tubing hanger 144 to be fluidly isolated from other bores and passages within the completion system 100.

Further, one or more additional stabs or similar components may be included within the completion system 100, such as positioned about or adjacent the production bore stab 190 to have additional bores and passages of the production tree 110 in fluid communication with the tubing hanger 144. For example, one or more auxiliary passage stabs 192 may be positioned between the auxiliary passage of the production tree 110 and the auxiliary passage 148 of the tubing hanger 144, thereby isolating and fluidly coupling the auxiliary passage of the production tree 110 to the auxiliary passage 148 of the tubing hanger 144. The auxiliary passage stab 192 shown in the embodiment in FIGS. 1A and 1B may be an individual sleeve positioned adjacent the production bore stab 190, and may be used to fluidly isolate the auxiliary passage from the production bore between the production tree 110 and the tubing spool 144. As such, one end of the auxiliary passage stab 192, such as the top end shown in FIGS. 1A and 1B, may seal against and within the auxiliary passage of the production tree 110, and another end of the auxiliary passage stab 192, such as the bottom end shown in FIGS. 1A and 1B, may seal against and within the auxiliary passage 148 of the tubing hanger 144. This arrangement may enable the auxiliary passage of the production tree 110 and the tubing hanger 144 to be fluidly isolated from other bores and passages within the completion system 100.

Furthermore, a valve control passage stab 194 may be positioned between the valve control passage 132 of the production tree 110 and the valve control passage 150 of the tubing hanger 144, thereby isolating and fluidly coupling the valve control passage 132 of the production tree 110 to the valve control passage 150 of the tubing hanger 144. The valve control passage stab 194 shown in the embodiment in FIGS. 1A and 1B may be an individual sleeve positioned adjacent the production bore stab 190, and may be used to fluidly isolate the valve control passage from the production bore between the production tree 110 and the tubing spool 144. As such, one end of the valve control passage stab 194, such as the top end shown in FIGS. 1A and 1B, may seal against and within the valve control passage 132 of the production tree 110, and another end of the valve control passage stab 194, such as the bottom end shown in FIGS. 1A and 1B, may seal against and within the valve control passage 150 of the tubing hanger 144. This arrangement may enable the valve control passage of the production tree 110 and the tubing hanger 144 to be fluidly isolated from other bores and passages within the completion system 100.

In accordance with one or more embodiments of the present disclosure, a completion system of the present disclosure may include a tubing spool that may be valve-less. For example, as shown and discussed above, a tubing hanger may include one or more valves, such as a sliding sleeve valve, such that fluid (e.g., liquid or gas) and/or any particulate contained within the annulus outside of and exterior to the production tubing may pass through the tubing hanger and into the production tree while not interfering with the production bore. Accordingly, the valve in the tubing hanger may be used to selectively control the fluid passing through the tubing hanger. Further, as shown and discussed above, the valve within the tubing hanger may be activated and controlled using a valve control passage, in addition or in alternative to other methods. As shown above, the valve may be selectively controlled, such as moved between the open position and the closed position, by selectively increasing or decreasing pressure within the valve control passage.

As such, as an example of operation with reference to FIGS. 1A and 1B, increased pressure may be provided through the valve control passage 132 of the production tree 110, thereby providing increased pressure through the valve control passage stab 194 and into the valve control passage 150 of the tubing hanger 144. This increased pressure may move the valve 152 from the closed position, as shown in FIG. 1B, to the open position, as shown in FIG. 1A. When the valve 152 is in the open position, fluid may then pass from the annulus 172, through the lower portion 148B of the auxiliary passage 148, the flow passage 154 of the valve 152, and the upper portion 148A of the auxiliary passage 148. The fluid may then continue to pass through the auxiliary passage stab 192 and into the lower auxiliary passage 126 and the upper auxiliary passage 122 of the production tree 110, thereby allowing the fluid to be vented from the annulus 172 without interfering with the interior of the production tubing 170.

Accordingly, by not including a valve within the tubing spool, a completion system in accordance with the present disclosure may have a reduced number of components and moving parts contained therein, thereby reducing the complexity for the completion system. For example, in certain environments, such as the North Sea, regulations are used to restrict the overall height for a completion system to prevent interference with the fishing environment. A completion system in accordance with the present disclosure may be used in such an environment, such as due to the reduced complexity and overall height for the completion system.

Further, in one or more embodiments, a tubing hanger of a completion system may be used as an orientation feature, such as when assembling the completion system. For example, as shown in FIGS. 1A and 1B, the tubing hanger 144 may include the auxiliary passage 148 and the valve control passage 150, whereas the tubing spool 140 may not include any passages or flow paths formed therein. As such, when assembling the completion system 110, the production tree 110 may only needed to be aligned and oriented with the tubing hanger 144, and not the tubing spool 140, such as to have the lower auxiliary passage 126 and the valve control passage 132 of the production tree 110 aligned and in fluid communication with the auxiliary passage 148 and the valve control passage 150 of the tubing hanger 144, respectively.

In embodiments in which a production tree must be aligned with a tubing spool, such as when having to fluidly couple passages and bores of the production tree with passages and bores of the tubing spool, the production tree must also be aligned with a wellhead, as the tubing spool may be mounted on the wellhead. In such an embodiment, as the wellhead may already be set and placed within a well, the production tree must be correctly aligned and oriented with the tubing spool, and the tubing spool must be correctly aligned and oriented with the wellhead. As such, one or more tools may be used to correctly align and orient these components with respect to each other, such as by using an orientation joint to correctly orient the tubing hanger in the wellhead. For example, in previous embodiments of a production or completion system, an assembly of blowout preventers ("BOPs") or a BOP stack is used in conjunction with a tubing hanger orientation joint that is located in the tubing hanger landing string for the purpose to align and position the tubing hanger within the wellhead. In such an embodiment, the BOP stack is first aligned and coupled to a wellhead orientation feature, such as a post. A slot in the tubing hanger orientation joint receives a pin extending from the BOP stack, thereby aligning or orienting the tubing hanger in a desired position within the wellhead with respect to the post. After the BOP stack is removed, components of the production or completion system, such as the production tree, are then landed and aligned to the same wellhead feature or post, and consequently the production tree is therefore aligned to the position of the tubing hanger.

However, in accordance with one or more embodiments of the present disclosure, the tubing hanger 144 may only need to be aligned and oriented with the tubing spool 140. For example, the tubing hanger 144 may be re-oriented within the tubing spool 140 (e.g., rotated with respect to the tubing spool 140), as needed, such as when mounting the production tree 110 to the tubing spool 140, to facilitate orienting the production tree 110 with the tubing hanger 144. Such a feature may prevent additional tools or joints that may be necessary in other completion systems when aligning, mounting, and orienting components within such completion systems. For example, such a feature may prevent the need of a tubing hanger orientation joint and a uniquely equipped BOP stack, or other similar equipment, to orient components of the completion or production system, such as the production tree and tubing hanger. Therefore, installing the tubing hanger directly into the tubing spool, instead of directly into the wellhead, may result in a reduction of operating expenditures and an increase of BOP stack availability.

Figure 2A:
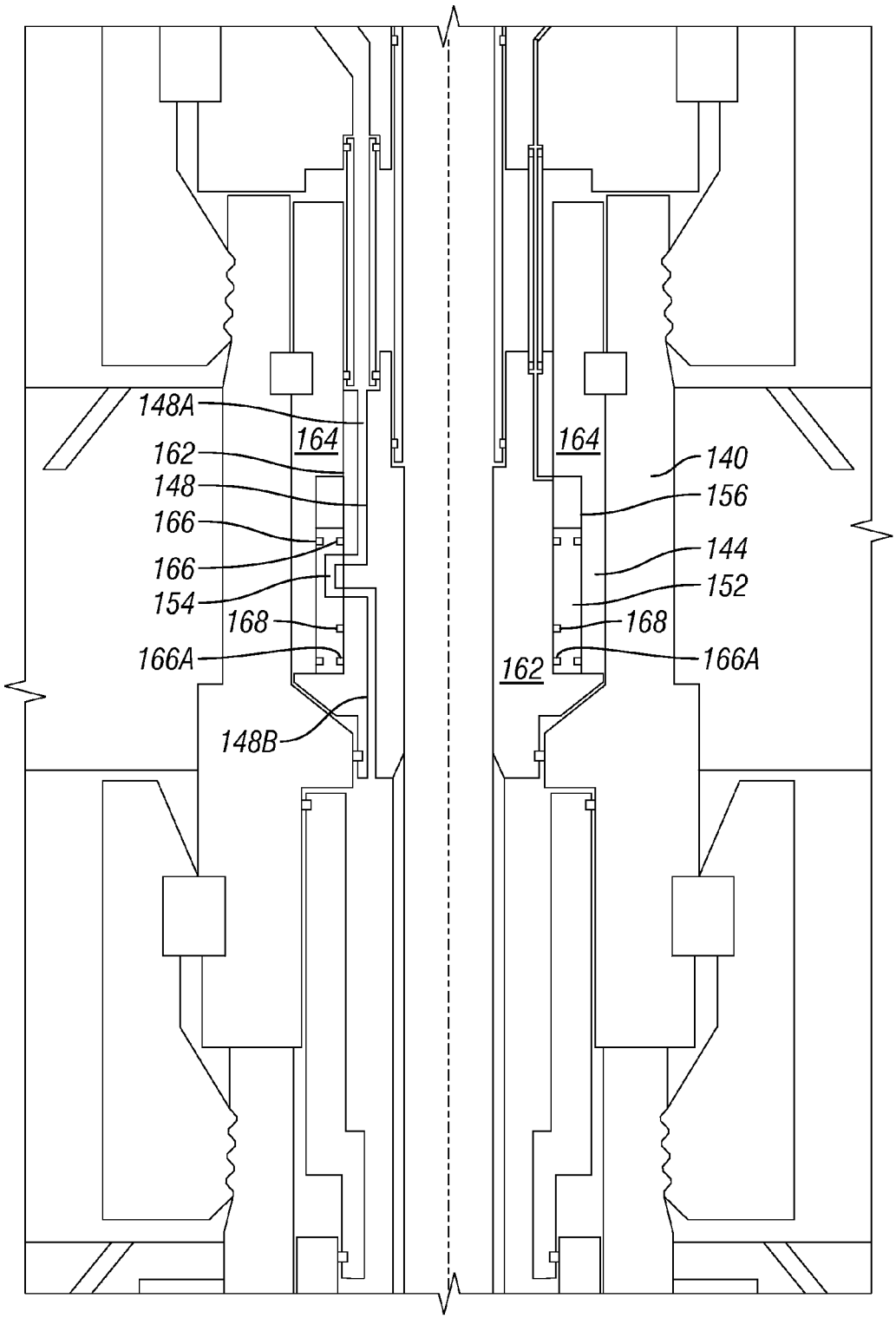
FIGS. 2A and 2B show multiple cross-sectional views of a tubing spool and a tubing hanger of a completion system in accordance with one or more embodiments of the present disclosure.
Figure 2B:
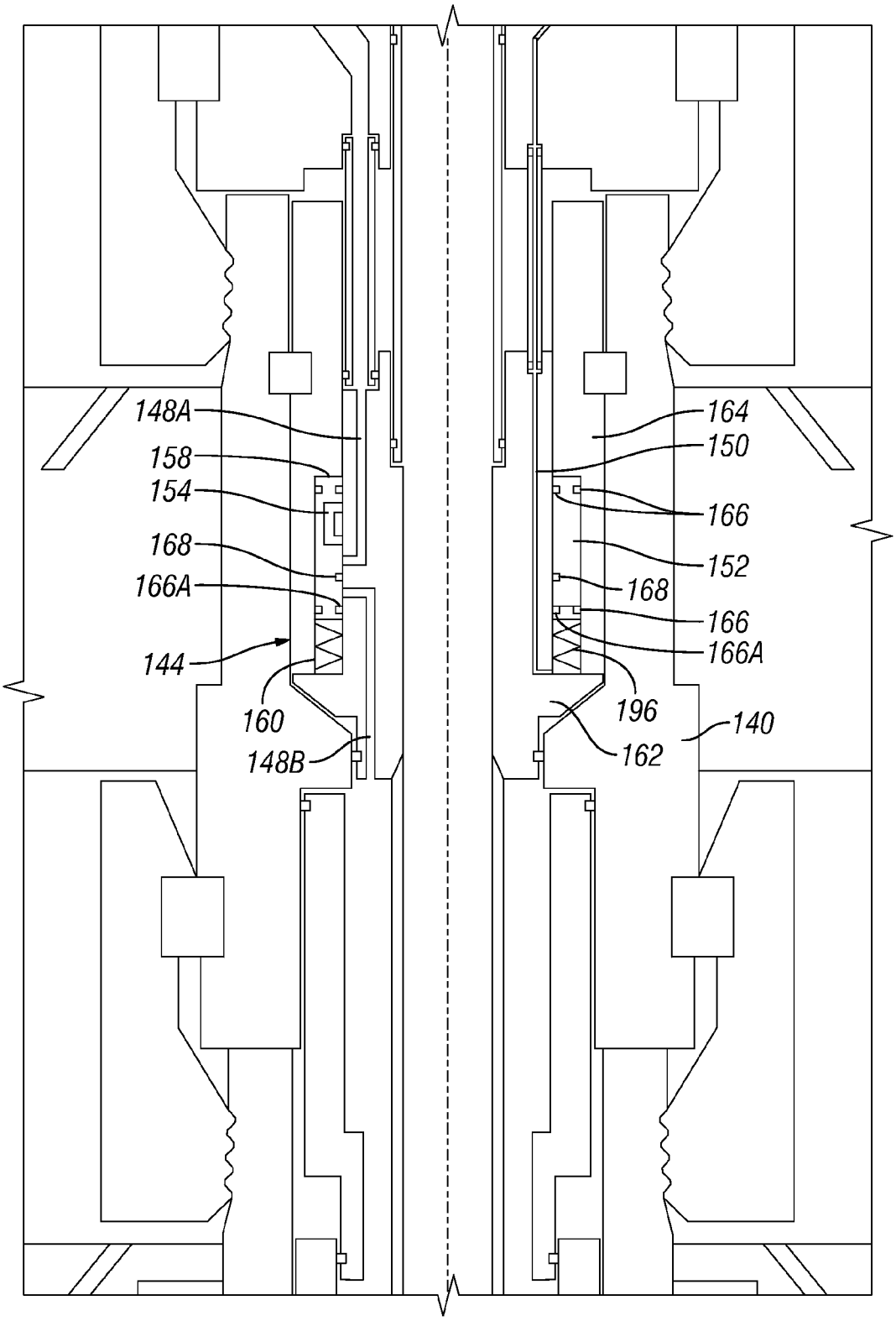

In one or more embodiments of the present disclosure, a tubing hanger in accordance with the present disclosure may be formed in one or more pieces and/or one or more components. For example, referring now to FIGS. 2A and 2B, multiple cross-sectional views of the tubing spool 140 and the tubing hanger 144 in accordance with one or more embodiments of the present disclosure are shown. FIG. 2A shows the valve 152 positioned within the cavity 156 of the tubing hanger 144 in the open position, and FIG. 2B shows the valve 152 positioned within the cavity 156 of the tubing hanger 144 in the closed position. As such, the tubing hanger 144 may include an inner valve housing 162 and an outer valve housing 164 in this embodiment. For example, the inner valve housing 162 and the outer valve housing 164 may be coupled together, such as threadedly connected to each other or through the use of one or more retaining rings, to form the cavity 156 within the tubing hanger 144. The valve 152 may then be positioned within the cavity 156, such as when coupling the inner valve housing 162 and the outer valve housing 164 to each other to form the cavity 156.

A valve of a tubing hanger in accordance with one or more embodiments of the present disclosure may be biased, such as biased towards an open position and/or a closed position. In one or more embodiments, a biasing mechanism, such as a spring, may be used to bias the valve of the tubing hanger. For example, a spring positioned within the cavity 156 of the tubing hanger 144 and/or adjacent the valve 152 to urge and bias the valve 152 towards the open position and/or the closed position. Pressure may then be introduced into the valve control passage 150 of the tubing hanger 144 to overcome the biasing force against the valve 152 to move the valve 152 between the open position and the closed position. For example, as shown in FIG. 2B, a spring 196 may be positioned within the cavity 156 and on the closing side 160 of the cavity 156 to urge and bias the valve 152 towards the closed position. In such an embodiment, pressure may only need to be used to move the valve 152 to the open position, such as by overcoming the biasing force of the spring 196.

A valve in accordance with one or more embodiments of the present disclosure may include one or more seals. For example, as shown in FIGS. 2A and 2B, the valve 144 may include one or more seals 166 positioned about the inner and outer surfaces at the ends of the valve 144. Further, one or more secondary seals may also be included with the valve 144. For example, the valve 144 may include a secondary seal 168 positioned adjacent the seal 166A on the inner surface of the lower end of the valve 144. Accordingly, when the valve 152 is in the closed position, as shown in FIG. 2B, the secondary seal 168 and the seal 166A may be positioned on opposite sides of an opening of the auxiliary passage 148 of the tubing hanger 144, in particular the opening of the lower portion 148B of the auxiliary passage 148. Such a configuration may facilitate preventing fluid from leaking past the valve 152 when in the closed position.

A valve in accordance with one or more embodiments of the present disclosure may include one or more redundancy devices to facilitate moving the valve in the tubing hanger between the open position and the closed position. For example, a back-up hydraulic cylinder, such as a slave cylinder and/or a secondary sleeve cylinder, may be used with the valve to assist in movement between the open position and the closed position, such as if one or more components within the completion system fails. In particular, in an embodiment in which one or more seals may fail on the valve, the valve may need assistance in moving from the open position to the closed position and/or vice-versa. In such an embodiment, a slave cylinder may be included within the completion system, such as positioned adjacent the valve and/or in the cavity with the valve, to facilitate movement of the valve. The slave cylinder may be positioned and used to move the valve from the open position to the closed position, such as if complications otherwise prevent the valve from moving from the open position to the closed position. Similarly, the slave cylinder may be positioned and used to move the valve from the closed position to the open position, such as if complications otherwise prevent the valve from moving from the closed position to the open position.

Although the present invention has been described with respect to specific details, it is not intended that such details should be regarded as limitations on the scope of the invention, except to the extent that they are included in the accompanying claims.

What is claimed is:

1. A subsea completion system for a subsea well and including a vertical subsea production tree, the system comprising:

a tubing spool separate from and installed below the vertical subsea production tree and above a subsea wellhead, the tubing spool including an internal bore extending vertically therethrough with no lateral production outlet; and a tubing hanger movable into a landed position within the internal bore of the tubing spool, the tubing hanger including:

a hanger production bore extending vertically therethrough with no lateral production outlet;

an auxiliary passage formed therethrough outside of the hanger production bore; and a valve positioned within the tubing hanger and configured to control the flow of fluid through the auxiliary passage.

2. The subsea completion system of claim 1, further comprising production tubing supported within the hanger production bore of the tubing hanger such that an annulus is formed outside the production tubing and the auxiliary passage of the tubing hanger is in fluid communication with the annulus.

3. The subsea completion system of claim 1, wherein the auxiliary passage of the tubing hanger extends from a top side to a bottom side of the tubing hanger.

4. The subsea completion system of claim 1, further comprising a biasing mechanism to bias the valve towards one of an open position and a closed position.

5. The subsea completion system of claim 1, further comprising a redundancy device to move the valve towards one of an open position and a closed position.

6. The subsea completion system of claim 1, wherein the tubing hanger includes a hanger valve control passage in fluid communication with the valve to control the movement of the valve between an open position and a closed position.

7. The subsea completion system of claim 1, wherein the tubing spool is valve-less.

8. The subsea completion system of claim 1, wherein the valve comprises a sliding sleeve valve.

9. The subsea completion system of claim 1, wherein the tubing hanger comprises an inner valve housing and an outer valve housing coupled together such that the valve is movable within a cavity formed between the inner valve housing and the outer valve housing.

10. The subsea completion system of claim 1, wherein the vertical subsea production tree includes:

a tree production bore formed therethrough; and an auxiliary passage formed therethrough outside of the tree production bore;

wherein, when the vertical subsea production tree is installed on the tubing spool, the tree production bore of the vertical subsea production tree is in fluid communication with the hanger production bore of the tubing hanger; and wherein, when the vertical subsea production tree is installed on the tubing spool, the auxiliary passage of the subsea production tree is in fluid communication with the auxiliary passage of the tubing hanger.

11. A subsea completion system for a subsea well, comprising:

a tubing spool including an internal bore extending vertically therethrough with no lateral outlet, the tubing spool separate from the installable above a subsea wellhead;

a tubing hanger movable into a landed position within the spool internal bore of the tubing spool, the tubing hanger including:

a hanger production bore extending vertically therethrough with no lateral production outlet;

an auxiliary passage formed therethrough outside of the hanger production bore; and a valve positioned within the tubing hanger and configured to control the flow of fluid through the auxiliary passage; and a vertical subsea production tree separate from and installable on the tubing spool, the vertical subsea production tree including:

a tree production bore formed therethrough; and an auxiliary passage formed therethrough outside of the tree production bore;

wherein, when the vertical subsea production tree is installed on the tubing spool and the tree production bore of the vertical subsea production tree is in fluid communication with the hanger production bore of the tubing hanger; and wherein, when the vertical subsea production tree is installed on the tubing spool and the auxiliary passage of the subsea production tree is in fluid communication with the auxiliary passage of the tubing hanger.

12. The subsea completion system of claim 11, wherein:

the tubing hanger includes a hanger valve control passage in fluid communication with the valve to control the operation of the valve;

the vertical subsea production tree includes a valve control passage formed therethrough outside of the tree production bore and the auxiliary passage; and when the vertical subsea production tree is installed on the tubing spool, the valve control passage of the subsea production tree is in fluid communication with the hanger valve control passage of the tubing hanger.

13. The subsea completion system of claim 12, further comprising:

a production bore stab positioned between the tree production bore of the vertical subsea production tree and the hanger production bore of the tubing hanger to isolate and fluidly couple the tree production bore of the vertical subsea production tree and the hanger production bore of the tubing hanger;

an auxiliary passage stab positioned between the auxiliary passage of the vertical subsea production tree and the auxiliary passage of the tubing hanger to isolate and fluidly couple the auxiliary passage of the vertical subsea production tree and the auxiliary passage of the tubing hanger; and a valve control passage stab positioned between the valve control passage of the vertical subsea production tree and the hanger valve control passage of the tubing hanger to isolate and fluidly couple the valve control passage of the vertical subsea production tree and the hanger valve control passage of the tubing hanger.

14. The subsea completion system of claim 11, further comprising:

the subsea wellhead including a central bore formed therethrough; and production tubing supported within the hanger production bore of the tubing hanger;

wherein the production tubing extends, at least partially, into the central bore of the subsea wellhead;

wherein an annulus is formed exterior to the production tubing; and wherein the auxiliary passage of the tubing hanger is in fluid communication with the annulus.

15. The subsea completion system of claim 11, further comprising a biasing mechanism to bias the valve towards one of an open position and a closed position.

16. The subsea completion system of claim 11, further comprising a redundancy device to move the valve towards one of an open position and a closed position.

17. The subsea completion system of claim 11, wherein the tubing hanger comprises an inner valve housing and an outer valve housing coupled together such that a cavity is formed between the inner valve housing and the outer valve housing with the valve positioned within the cavity.

18. The subsea completion system of claim 11, wherein the auxiliary passage of the tubing hanger extends from a top of the tubing hanger to a bottom of the tubing hanger.

19. The subsea completion system of claim 17, wherein the tubing spool is valve-less.

20. The subsea completion system of claim 17, wherein the valve comprises a sliding sleeve valve.

* * * * *